US005335859A

United States Patent [19]

Thayer et al.

[11] Patent Number: 5,335,859

[45] Date of Patent: Aug. 9, 1994

[54] LOW-VOLUME IRRIGATION EMITTER WITH CHANGEABLE PATTERNS

[76] Inventors: Susan S. Thayer, 3808 Gaines Cove Dr., Winter Haven, Fla. 33884; Timothy D. Wert, 1417 Glendale St., Lakeland, Fla. 33803

[21] Appl. No.: 34,553

[22] Filed: Mar. 19, 1993

[51] Int. Cl.[5] ..... B05B 1/26

[52] U.S. Cl. ..... 239/390; 239/507; 239/513; 239/DIG. 1

[58] Field of Search ..... 239/390, 391, DIG. 1, 239/600, 392, 395, 507, 513

[56] References Cited

U.S. PATENT DOCUMENTS

| | | | |
|---|---|---|---|
| 675,672 | 6/1901 | Potter | 239/390 |
| 1,034,613 | 8/1912 | Godfree et al. | 239/390 |
| 1,405,810 | 2/1922 | Wilkieg | 239/390 |
| 1,639,162 | 6/1925 | Brooks | 239/390 |
| 1,913,278 | 12/1931 | Ivey | 239/390 |
| 2,711,925 | 9/1952 | King | 239/390 |
| 2,778,677 | 1/1957 | Gould et al. | 239/513 X |
| 4,512,519 | 4/1985 | Uzrad | 239/DIG. 1 X |
| 4,569,485 | 2/1986 | Walto | 239/507 X |
| 4,625,915 | 12/1986 | Cockman | 239/390 |
| 4,660,765 | 4/1987 | Rosenberg | 239/222.17 |
| 4,760,958 | 8/1988 | Greenberg | 239/513 X |
| 5,158,231 | 10/1992 | Christen et al. | 239/276 |

FOREIGN PATENT DOCUMENTS

| | | | |
|---|---|---|---|
| 1124211 | 10/1956 | France . | |
| 975101 | 11/1982 | U.S.S.R. . | |
| 1098574 | 6/1984 | U.S.S.R. | 239/390 |
| 9990 | of 1912 | United Kingdom . | |

*Primary Examiner*—Andres Kashnikow
*Assistant Examiner*—Lesley D. Morris

[57] ABSTRACT

An improved irrigation system for low-volume flow to individual plants or trees is presented. The system involves a detachable irrigation emitter with a flow deflector. In addition, an easily interchangeable dual flow pattern adapter is presented that can be slipped over the irrigation emitter in two different ways, thus providing two different deflection faces to produce two different flow patterns. Thus, with only one adapter, three distinct spray patterns may be selected at each plant site with much less time and labor than in previous systems. In a further embodiment, flow pattern adapters with three and four deflection surfaces are described, offering the choice of four and five distinct spray patterns at each plant site, respectively.

14 Claims, 2 Drawing Sheets

LOW-VOLUME IRRIGATION EMITTER WITH CHANGEABLE PATTERNS

BACKGROUND OF THE INVENTION

Irrigation systems for use in orchards have been designed whereby flow tubing is positioned along crops planted in rows and means are provided to divert flow via take-off tubing to individual plants or trees. In one embodiment, each plant is supplied with a stake that supports the take-off tubing, flow valve, and flow adapter to determine the flow pattern.

The flow adapter may be changed depending on the particular needs of the grower. For instance, a 360° misting may be desired, or perhaps just a small angle of flow might be preferable in a given situation. These flow patterns are determined by the shape and configuration of the adapter.

Previous systems have enabled adapters to be changed via threaded connections to the take-off tubing. This, however, can be cumbersome and slow, since a significant amount of time is required to remove one adapter and replace it with a new one. When multiplied over the number of plants or trees in an orchard, this may represent a sizeable investment in time and labor.

SUMMARY OF THE INVENTION

The present invention represents an improved apparatus for low-volume irrigation. This invention allows one to change the flow pattern to be delivered to each plant or tree quickly and easily when each plant is supplied with its own stake and tubing.

An irrigation emitter is inserted into the flow tubing via a threaded connecting means attached to its base. The irrigation emitter directs fluid flow through a bore in its threaded connector and base. The fluid stream then impinges on a deflector positioned on the underside of the top portion of the irrigation emitter. The shape of this deflector determines the flow pattern delivered to the plant.

A multiple flow pattern adapter is designed to laterally slide over the top part of the irrigation emitter, covering the irrigation emitter's deflector and guiding protrusions which fit into a symmetrical slot in the dual flow pattern adapter. The slot depth is calculated to ensure that the deflecting surface of the dual flow pattern adapter is concentric with the fluid flow stream from the bore in the irrigation emitter.

The multiple flow pattern adapter has two or more different deflecting surfaces so that the adapter may be interchanged by detaching it from the irrigation emitter, turning it, and sliding it laterally over the irrigation emitter's top arm again, thus exposing a new deflecting surface to the fluid stream.

Therefore, with very little labor, once the irrigation emitter has been inserted into the tubing, a multitude of deflecting surfaces may easily be accessed with one adapter. Furthermore, an unlimited number of additional surfaces may be provided with additional adapters, each of which supplies two or more deflecting surfaces.

DETAILED DESCRIPTION OF THE PREFERRED EMBODIMENT

The preferred embodiment of the present invention will be described with reference to the drawings.

Figure 1:
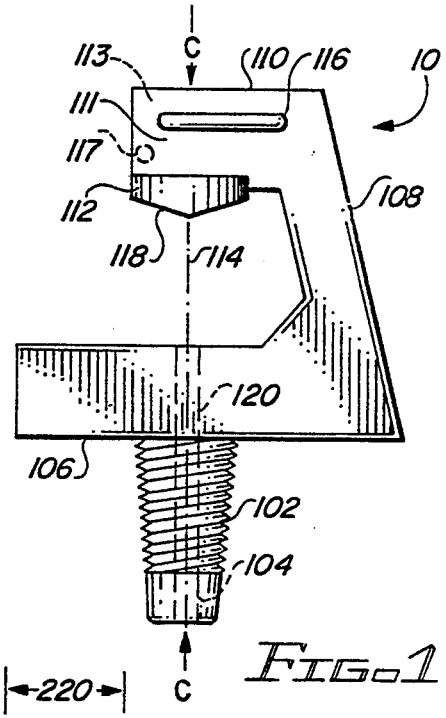
FIG. 1 is a side view of an irrigation emitter in accordance with the present invention.

FIG. 1 depicts the irrigation emitter 10, having a threaded connecting means 102 attached to a base 106 of a C-shaped portion of the irrigation emitter 10, the C-shaped portion comprising the base 106, side arm 108, and top arm 110.

The base 106 and threaded connecting means 102 possess communicating bores 104 and 120 through which fluid may flow along path 114.

Figure 2:
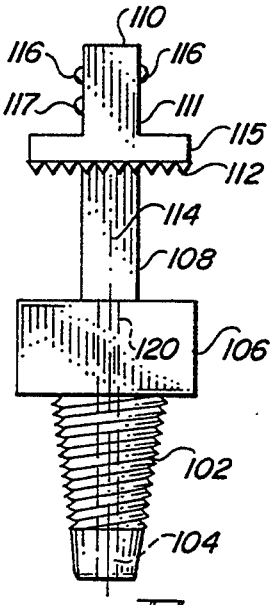
FIG. 2 is a front view of the irrigation emitter similar to that of FIG. 1.

The top arm 110 has flat sides 111, 113 with protrusions 116 on either side to serve as guiding means for the adapter (shown in combination in FIGS. 6–8) and protrusion 117 on side 113 serving as a detent lock. These protrusions 116, 117 are also shown in FIG. 2, a side cross-sectional view of the irrigation emitter 10.

Flow deflector means 112 are attached to the bottom face of the top arm 110, which comprises a flow-pattern-determining member 118, a cone-shaped protrusion of obtuse angle, which is positioned to be concentric with the flow stream path 114. The flow-pattern-determining member 118 shown in FIG. 1 produces a full circle fan spray of fluid. The member 115 shown in FIG. 2, a ring with tooth-shaped protrusions 122, produces a large diameter 360° spray. These are illustrative spray patterns and are not meant to limit the range of flow-pattern-determining members that may be utilized.

Figure 3:
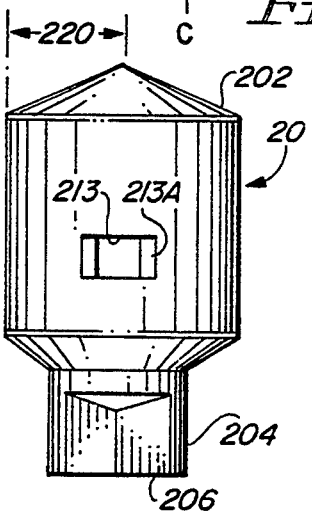
FIG. 3 is a rear view of a dual flow pattern adapter which is employed with the emitter of FIGS. 1 and 2.

FIG. 3 is a rear view of one embodiment of the dual flow pattern adapter 20. The top and bottom surfaces 202 and 204, respectively, both form flow deflector means. Top surface 202, a cone-shaped protrusion of obtuse angle, produces a full circle fan spray. Bottom surface 204 forms a solid cylinder with a wedge-shaped cutout 206 (see also FIG. 4), which produces a flow pattern whose angle is determined by the angle of the wedge-shaped cutout (here 90°). This angle may be varied in different embodiments to effect any flow angle desired. Opening 213 aids in the attachment of the adapter to the emitter (FIG. 6), and has an inner shoulder 213A.

Figure 4:
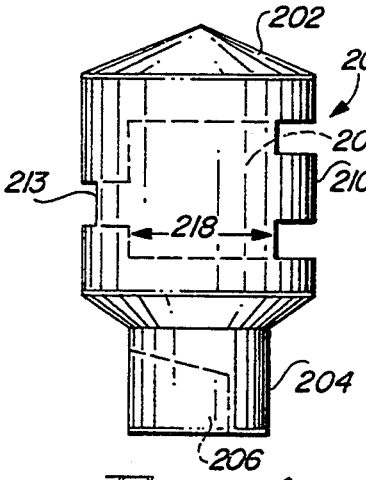
FIG. 4 is a side view of the dual flow pattern adapter.
Figure 5:
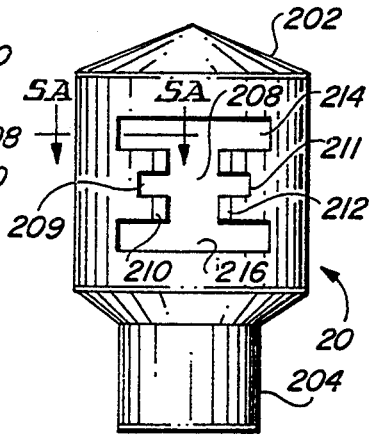
FIG. 5 is a front view of the dual flow pattern adapter.

FIGS. 4 and 5 show the symmetrical slot 208 from two different views, side and front, respectively. The symmetry is necessitated by the reversible nature of the dual flow pattern adapter 20. The central ridges 210 and 212 with guiding slots 209 and 211 are used for positioning in combination with the irrigation emitter 10 (see FIGS. 6–8). The larger portions 214 and 216 of the symmetrical slot are used to cover the flow deflector means 112 of irrigation emitter 10 ( see FIGS. 6–8 ).

Figure 5A:
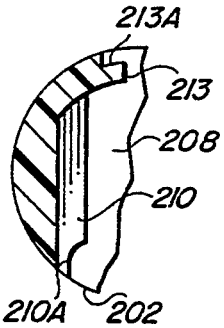
FIG. 5A is a partial cross-section through a portion of the adapter in FIG. 5, taken along 5A—5A.

Slot depth 218 is equal to the radius of the dual flow pattern adapter 20 minus one-half of the diameter of the flow deflector means 112. (This ensures that the center of the dual flow pattern adapter is positioned directly over the center of the bore 104 in the irrigation emitter 10 so that flow 114 impinges on the center of the dual flow pattern adapter surface 204 when in the combination illustrated in FIG. 7.) As shown in FIG. 5A, the forward edge 210A of ridge 210 is bevelled outwardly, in order to facilitate engagement with the arm 110. A similar feature is provided on ridge 212.

Figure 6:
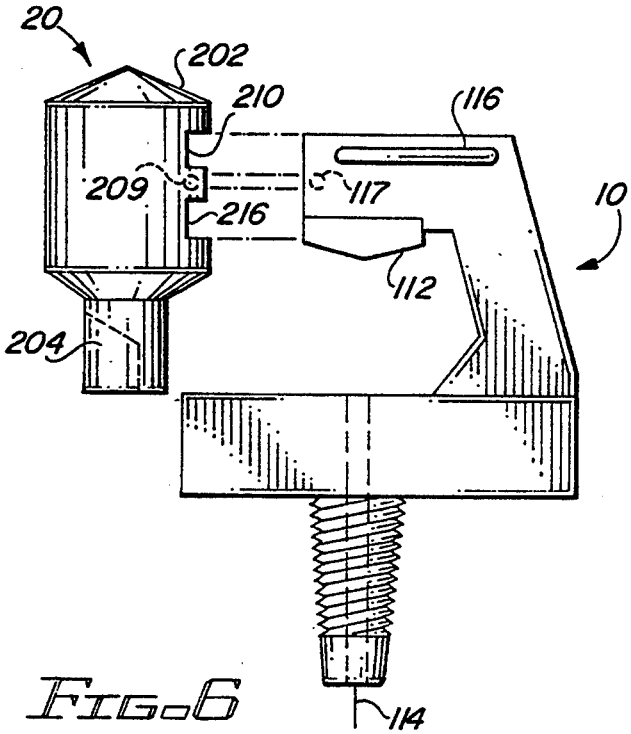
FIG. 6 illustrates the method of combining the irrigation emitter and dual flow pattern adapter.

FIG. 6 illustrates the combination of irrigation emitter and dual flow pattern adapter 20. Flow deflector means 112 fits into the larger portions 214 and 215 of the symmetrical slot 208, and ridges 210 and 212 slide between fluid deflection member 112 and protrusions 116, with protrusion 117 fitting into guiding slot 209.

Figure 7:
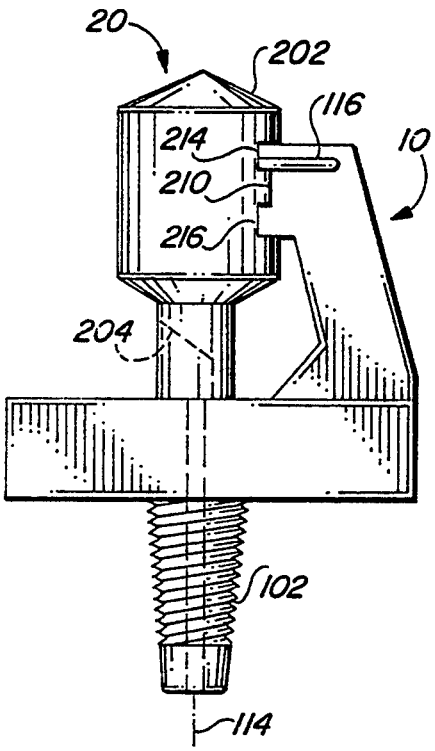
FIG. 7 shows the completed combination of the irrigation emitter and dual flow pattern adapter.
Figure 8:
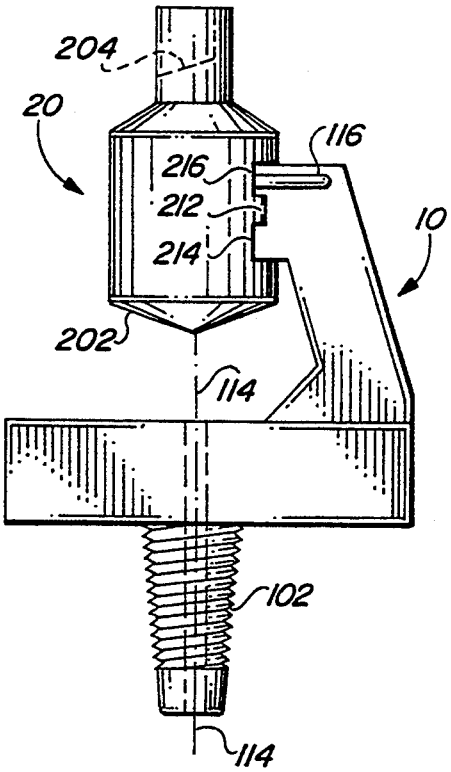
FIG. 8 shows the combination of the irrigation emitter and dual flow pattern adapter reversed from its position in FIG. 7.

The complete combination of irrigation emitter 10 and dual flow pattern adapter 20 is shown in FIG. 7, with surface 204 in position to determine the flow pattern, in this case a 90° wedge. The reversed combination with dual flow pattern adapter 20, having surface 202 in position to determine the flow pattern, in this case a 360° fan spray, is shown in FIG. 8.

Figure 9:
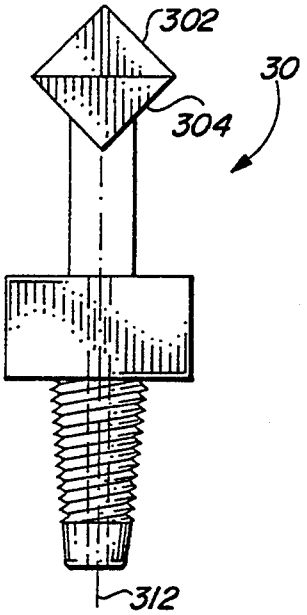
FIG. 9 is a front view of the irrigation emitter designed to receive three- and four-way pattern adapters.

Additional embodiments exist in which a three-way or four-way pattern adapter fits over the top arm 302 of the irrigation emitter 30 shown in FIG. 9. In these embodiments the cross section of the top arm 302, including flow deflecting means 304, is shaped to fit into symmetrical slots 408 and 510 in combinations of the irrigation emitter 30 and the three- and four-way pattern adapters shown in FIGS. 10 and 11, respectively.

Figure 10:
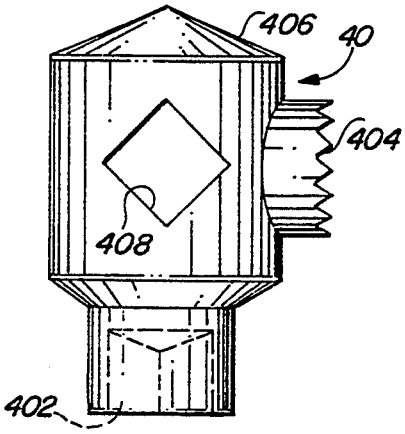
FIG. 10 is a front view of a three-way pattern adapter.

FIG. 10 is a front view of a three-way pattern adapter 40. Flow deflector means are provided by the surfaces 402, 404, and 406. As illustrated, the wedge-shaped cutout surface 402 produces a 90° flow pattern; the tooth-shaped protrusions on surface 404 produce a large diameter 360° spray; the cone-shaped surface 406 produces a fan-shaped spray. Symmetrical slot 408 is centrally positioned so that three-way pattern adapter 40 may be detachably affixed to irrigation emitter 30 in any of three positions to expose one of the surfaces 402, 404, or 406 to the fluid stream shown in FIG. 9.

Figure 11:
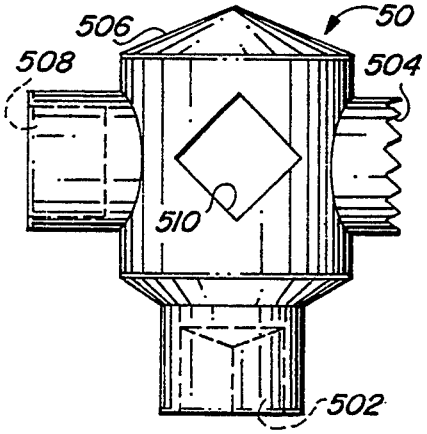
FIG. 11 is a front view of a four-way pattern adapter.

FIG. 11 is a front view of a four-way pattern adapter 50, which, in similar fashion to the three-way pattern adapter shown in FIG. 10, has four surfaces containing flow deflector means producing a 90° flow pattern 502, a large diameter 360° spray 504, a fan-shaped spray 506, and a 180° spray 508.

The embodiments shown here are meant to be illustrative examples of the possibilities available for easily interchanged adapters to produce virtually any spray pattern desired in irrigation systems and are not intended to limit the range of adapters and emitters from which one could choose for specific irrigation needs.

What is claimed is:

1. An irrigation emitter, comprising:

a first member having a base, an arm supported in spaced relation to the base, means for attaching the base with a source of water and means for defining a path of water flow through the base toward the arm, the arm comprising a side arm position extending generally lateral from the base and spaced from the path of water flow, and a top arm portion extending generally lateral from the side arm portion and across the path of water flow; and a second member having plural flow diverting surfaces, each flow diverting surface defining a different spray pattern, the second member including means for slidably engaging the arm so that a selected one of the flow diverting surfaces are position in the flow path, the slidable engaging means comprising a shaped slot in the second member, the slot dimensioned to receive the top arm portion in one of a plurality of positions, each position corresponding to one of the flow diverting surfaces.

2. The irrigation emitter recited in claim 1 wherein the spaced slot has symmetrical portions, each portion defining one of the positions.

3. The irrigation emitter recited in claim 2 wherein the top arm portion includes a fixture having a shape corresponding to each symmetrical portion.

4. The irrigation emitter recited in claim 4 wherein the second member further comprises ridges and guiding slots for receiving the top arm.

5. The irrigation emitter recited in claim 4 further comprising a detent protrusion on the top arm for engagement in one of the guiding slots.

6. The irrigation emitter recited in claim 3 wherein the top arm portion includes a fixed flow diverting surface facing the path of water flow, the fixed flow diverting surface comprising a portion of the shaped fixture.

7. The irrigation emitter recited in claim 2 wherein the second member includes a body portion and at least one extension with one of the flow diverting surfaces at the extremity of the extension.

8. An irrigation emitter comprising:

a first member having a base, means for attaching the base with a source of water, means for defining a path of water flow from the base, an arm fixed to the base and including a portion in the path of water flow, the arm including a first flow diverting surface in the path of water flow for defining a first spray pattern;

a second member having second and third flow diverting surfaces, respectively defining second and third spray patterns; and means for removably attaching the second member together with the first member so that a selected one of the second and third flow diverting surfaces are positioned in the flow path.

9. The irrigation emitter recited in claim 8 wherein the arm comprises:

a top arm portion;

means for supporting the top arm portion in spaced relation with the base; and wherein the top arm portion is dimensioned to receive the second member in sliding engagement.

10. The irrigation emitter recited in claim 9 wherein the second member further comprises a symmetrical slot shaped to receive the top arm portion in at least two positions.

11. The irrigation emitter recited in claim 9 wherein the second member further comprises a symmetrical slot shaped to receive the top arm portion in at least three different positions.

12. An irrigation emitter comprising:

a first member having a base, a top arm supported in spaced relation to the base, means for attaching the base with a source of water and means for defining a path of water flow from the base toward the top arm;

a second member having first, second and third flow diverting surfaces each of which respectively defines first, second and third spray patterns, the second member having a shaped slot dimensioned to receive the top arm in one of a plurality of positions, each position corresponding to one of the flow diverting surfaces; and wherein the first and second members are dimensioned such that the second member is removably attachable with the first member so that a selected one of the first, second and third flow diverting surfaces are positions in the flow patch.

13. The irrigation emitter recited in claim 12 wherein the second member further comprises a fourth flow diverting surface defining a fourth spray pattern.

14. An irrigation emitter comprising:

a first member having a base, means for attaching the base with a source of water, means for defining a path of water flow from the base, an arm fixed to the base and including a portion in the path of water flow, the arm including a first flow diverting surface on the portion in the path of water flow for defining a first spray pattern;

a second member having a second flow diverting surfaces defining second spray pattern; and means for removably attaching the second member together with the first member so that a selected one of the first and second flow diverting surfaces are selectively positioned in the flow path.

* * * * *